US008827745B2

(12) United States Patent
Tsujii et al.

(10) Patent No.: US 8,827,745 B2
(45) Date of Patent: Sep. 9, 2014

(54) CONNECTOR

(75) Inventors: Yoshitomo Tsujii, Yokkaichi (JP); Tomoyuki Sakata, Yokkaichi (JP); Masafumi Uno, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 48 days.

(21) Appl. No.: 13/821,719

(22) PCT Filed: Sep. 1, 2011

(86) PCT No.: PCT/JP2011/069886

§ 371 (c)(1),
(2), (4) Date: Mar. 8, 2013

(87) PCT Pub. No.: WO2012/039254

PCT Pub. Date: Mar. 29, 2012

(65) Prior Publication Data

US 2013/0171853 A1 Jul. 4, 2013

(30) Foreign Application Priority Data

Sep. 22, 2010 (JP) ..... 2010-212548

(51) Int. Cl.

| | |
|---|---|
| ***H01R 13/40*** | (2006.01) |
| ***H01R 13/52*** | (2006.01) |
| ***H01R 13/502*** | (2006.01) |
| ***H01R 13/422*** | (2006.01) |

(52) U.S. Cl.

CPC ..... *H01R 13/5219* (2013.01); *H01R 13/5205* (2013.01); *H01R 13/5025* (2013.01); *H01R 13/521* (2013.01); *H01R 13/4223* (2013.01)

USPC ..... 439/587

(58) Field of Classification Search

USPC ..... 439/587, 589

See application file for complete search history.

(56) References Cited

U.S. PATENT DOCUMENTS 6,815,610 B2 * 11/2004 Kuboshima et al. ..... 174/360
8,545,265 B2 * 10/2013 Sakamoto et al. ..... 439/606

(Continued)

FOREIGN PATENT DOCUMENTS

JP A-2006-185875 7/2006
JP A-2007-165191 6/2007

(Continued)

OTHER PUBLICATIONS

International Search Report issued in International Patent Application No. PCT/JP2011/069886 dated Oct. 25, 2011.

(Continued)

*Primary Examiner* — Phuong Dinh
(74) *Attorney, Agent, or Firm* — Oliff PLC

(57) ABSTRACT

A connector includes a connector housing having a cavity, a male terminal having a protruded portion, a sealing ring receiving recess included in the connector housing, a sealing ring arranged in the sealing ring receiving recess, and a retainer mounted in the connector housing and pressing the sealing ring from a front side of the protruded portion of the male terminal. The male terminal is housed in the cavity in a way that the protruded portion protrudes from the connector housing. The sealing ring receiving recess is located at a position corresponding to a base section of the male terminal that is on a side from which the protruded portion protrudes. The male terminal passes through the sealing ring such that it seals a space between the male terminal and an inner surface of the sealing ring receiving recess. The retainer includes an engagement portion engaged with the male terminal.

6 Claims, 18 Drawing Sheets

(56) References Cited

U.S. PATENT DOCUMENTS

| | | | | |
|---|---|---|---|---|
| 8,672,706 | B2 * | 3/2014 | Matsumoto et al. | 439/489 |
| 2006/0063412 | A1 | 3/2006 | Matsumoto et al. | |

FOREIGN PATENT DOCUMENTS

| | | |
|---|---|---|
| JP | B2-4401915 | 1/2010 |
| JP | A-2010-153143 | 7/2010 |

OTHER PUBLICATIONS

Written Opinion of the International Searching Authority issued in International Patent Application No. PCT/JP2011/069886 dated Oct. 25, 2011.

* cited by examiner

CONNECTOR

TECHNICAL FIELD

The present invention relates to a connector.

BACKGROUND ART

A connector described in Patent Document 1 is known as a conventional connector having a structure for preventing a liquid such as water and oil from intruding into a cavity of a connector housing.

The connector described in Patent Document 1 houses a male tab terminal connected to an end of an electric wire in a terminal receiving chamber of the connector housing. The male tab terminal has a recessed O-ring mounting portion. An O-ring mounted to the O-ring mounting portion is in close contact with an inner surface of the terminal receiving chamber. With this configuration, the liquid such as water and oil is prevented from intruding into the terminal receiving chamber.

Patent Document 1: Japanese Patent No. 4401915

In the configuration described in Patent Document 1, if force acts on the electric wire in a direction toward a side to which the male tab terminal is removed, the male tab terminal may drop off from the O-ring and may be slipped out of the terminal receiving chamber. Further, as illustrated in FIG. 8 of Patent Document 1, in the fitting of a male connector housing (a housing to be connected), the O-ring is pressed against the male connector housing and positioned. Thus, the O-ring may be readily incorrectly positioned before the fitting of the male connector housing.

There is a need in the art to provide a connector in which a terminal hardly drops off from a cavity and a sealing ring is hardly incorrectly positioned.

SUMMARY

A connector according to the present invention includes a connector housing having a cavity, a terminal having a protruded portion, a sealing ring receiving recess included in the connector housing, a sealing ring arranged in the sealing ring receiving recess, and a retainer mounted in the connector housing and pressing the sealing ring from a front side of the protruded portion of the terminal. The terminal is housed in the cavity in a way that the protruded portion protrudes from the connector housing. The sealing ring receiving recess is located at a position corresponding to a base section that is on a side from which the protruded portion protrudes. The terminal passes through the sealing ring such that the sealing ring seals a space between the terminal and an inner surface of the sealing ring receiving recess. The retainer includes an engagement portion engaged with the terminal.

According to this configuration, the retainer mounted in the connector housing presses the sealing ring from the end of the protruded portion of the terminal. Further, the retainer includes the engagement portion to be engaged with the terminal. Thus, the terminal hardly drops off from the cavity and the sealing ring is hardly incorrectly positioned.

EXPLANATION OF SYMBOLS

Figure 1:
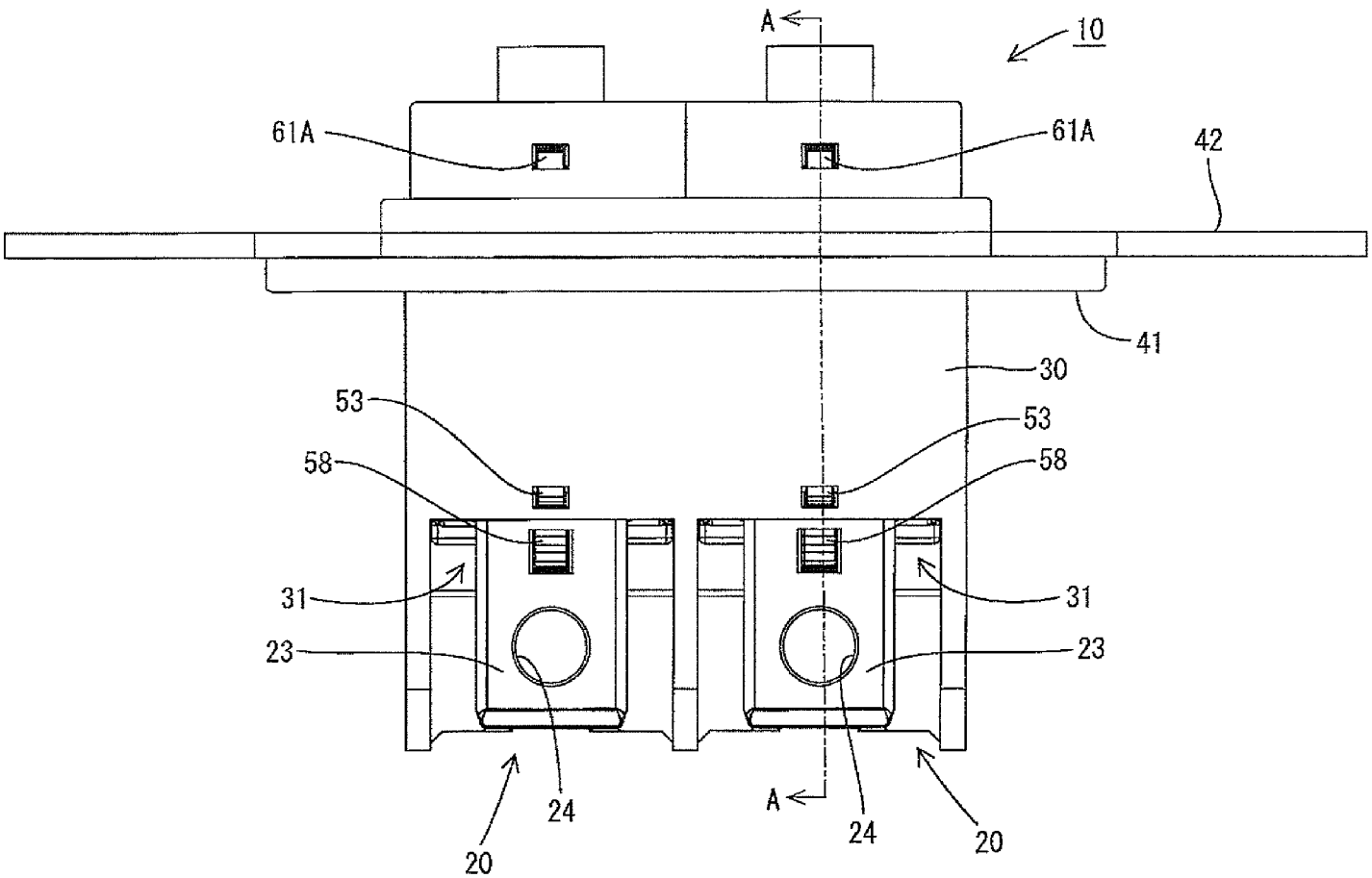
FIG. 1 is a front view of a connector according to a first embodiment of the present invention.

10: Connector
11: Electric wire
12: Conductor
13: Wire insulation
20: male terminal (terminal)
21: Wire connecting portion
22: Sealing ring mounting portion
23: Protruded portion
24: Bolt hole (through hole)
25: Engagement hole
30, 80: Housing
31: Terminal housing
32: Cavity
33: Sealing ring receiving recess
34: Retainer mounting recess
35, 81: Locking hole
36: Opening
37, 72: Nut holding portion
38, 73: Holding wall
39, 74: placement portion
40: Insertion portion
45: Sealing ring
46: Terminal through hole
50, 70: Retainer
51: Pressing portion
52: Terminal through hole
53, 76: Locking portion
53A, 76A: Stepped portion
54, 71: Support portion
55: Projected portion
56: Small-width projected portion
58: Engagement portion
58A: Stepped portion
64: Nut
64A: Screw hole
65: Bolt
Ta: Male tab

BEST MODE FOR CARRYING OUT THE INVENTION

<First Embodiment>

A connector 10 according to a first embodiment of the present invention will be described with reference to FIG. 1 to FIG. 16.

The connector 10 is attached to an end portion of a wire harness routed between members such as a battery, an inverter, and a motor (not illustrated) that constitutes a power source for driving a vehicle such as a hybrid automobile and an electric automobile. In the present embodiment, the connector 10 is connected to the end portion of the wire harness on a motor side rather than the inverter side and is attached to a case of a device on the motor side. Hereinafter, an up-and-down direction will be explained based on FIG. 2. A right side and a left side in FIG. 2 will be referred to as a front side and a rear side, respectively.

Figure 2:
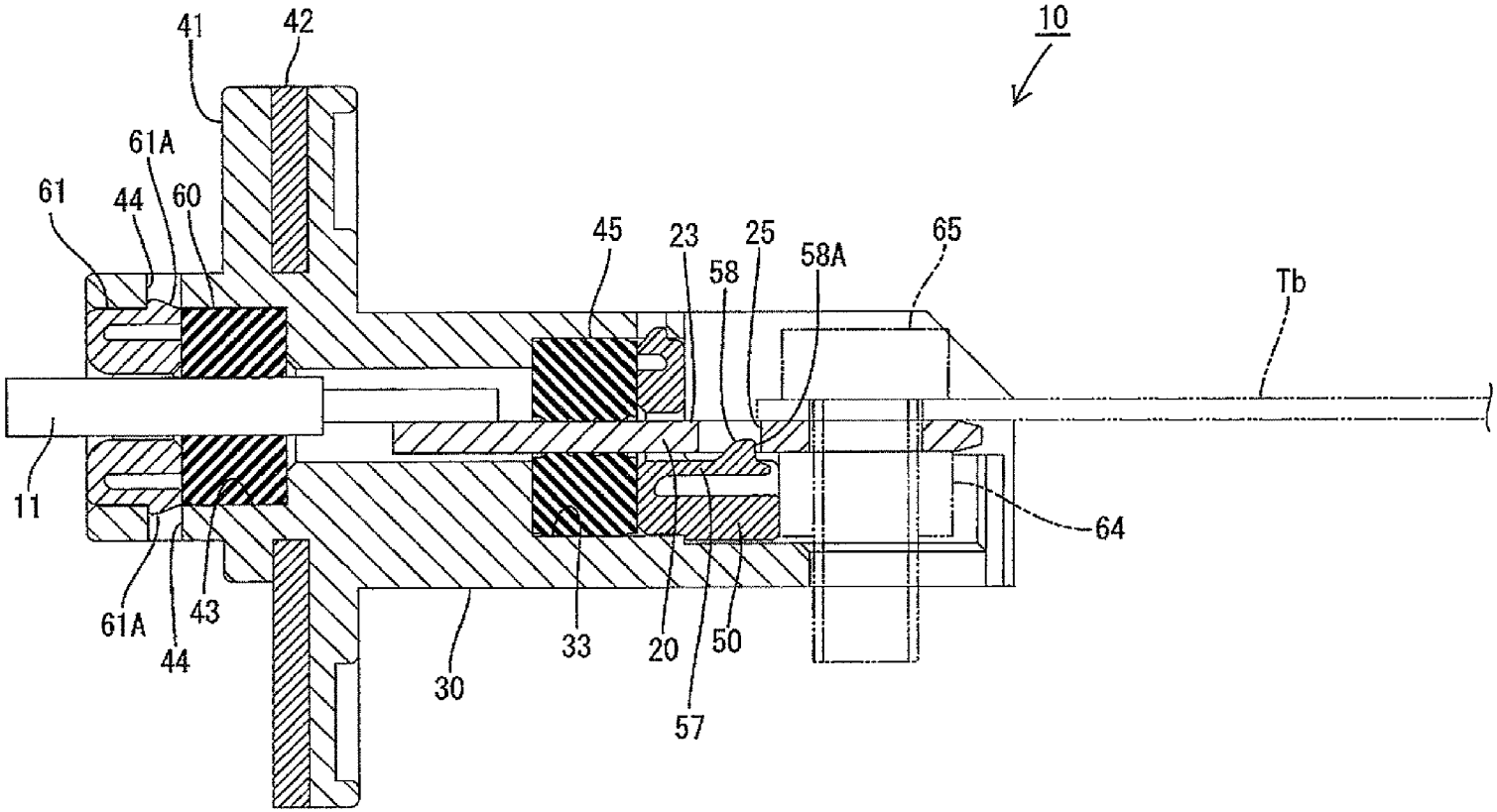
FIG. 2 is a cross-sectional view taken along a line A-A in FIG. 1.

As illustrated in FIG. 2, the connector 10 includes a male terminal 20 (one example of a terminal), a connector housing 30 (hereinafter, referred to as the housing 30), a sealing ring 45, and a retainer 50. The male terminal 20 includes a protruded portion 23. The connector housing 30 houses the male terminal 20. The sealing ring 45 is attached to the male terminal 20 at a base section from which the protruded portion 23 protrudes. The retainer 50 is attached to the housing 30 and presses the sealing ring 45 from an end of the protruded portion 23.

Figure 3:
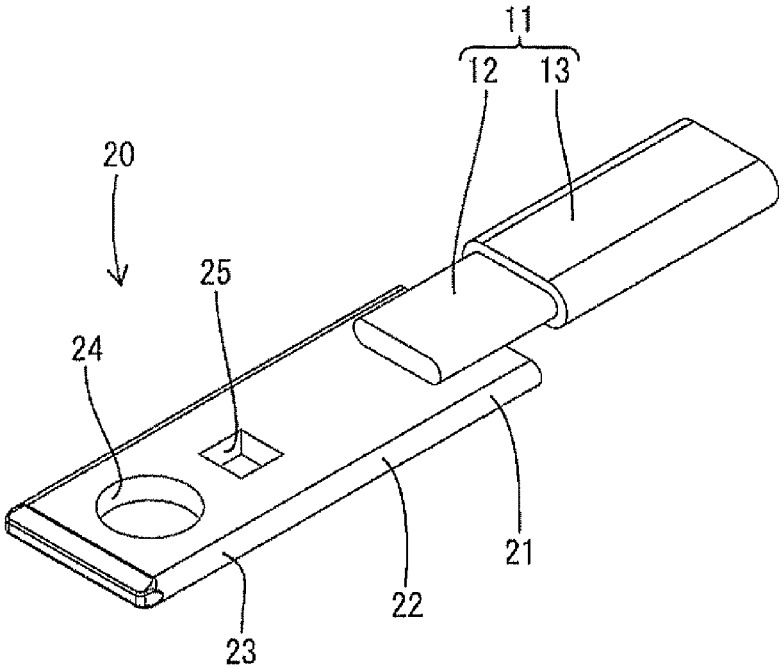
FIG. 3 is a view illustrating a state in which an end portion of a wire is connected with the male terminal.

As illustrated in FIG. 3, the male terminal 20 has a strip shape elongated in the front-to-rear direction. The male terminal 20 includes a wire connecting portion 21 and the protruded portion 23 continuously extending forwardly from the wire connecting portion 21. To the wire connecting portion 21, an electric wire 11 is attached. The protruded portion 23 protrudes from (a sealing ring receiving recess 33 of) the housing 30. The male terminal 20 is formed in a flat shape by an extrusion molding and then is punched by a press. Side edges of the male terminal (ends in a width direction) are rounded.

The electric wire 11 includes a conductor 12 and an wire insulation 13 each in a flat shape. The conductor includes bundles of helically stranded copper-alloy wires arranged to be in contact with each other.

The electric wire 11 in such a shape has a high electric power transmission, and further has high heat dissipation properties, because a large area thereof is exposed to the air. Further, the electric wire 11 can be easily folded due to its flat shape. This facilitates the routing of the electric wire 11.

The extruded wire connecting portion 21 has a flat plate shape. The wire connecting portion 21 and the electric wire 11 are connected by brazing the conductor 12, which is exposed by stripping the wire insulation 13 of the electric wire 11, and the wire connecting portion 21 (in which an alloy having a lower melting point than the conductor 12 and the wire connecting portion 21 (a conductive material such as solder) is melted at a high temperature to be in a paste form, and the melted alloy is applied to the connecting portion and solidified).

The male terminal 20 includes a sealing ring mounting portion 22, to which the sealing ring 45 is mounted, at the base section continuously extending forwardly from the wire connecting portion 21. On a front side of the sealing ring mounting portion 22, the protruded portion 23 includes an engagement hole 25 having a rectangular shape and a bolt hole 24 (one example of a through hole) having a circular shape. The bolt hole 24 is positioned on a front side of the engagement hole 25 and allows an axial portion 65B of a bolt 65 passes therethrough.

Instead of the extrusion molding, the male terminal 20 may be obtained by pressing a metal having a circular cross-sectional shape into a flat shape.

The housing 30 is made of a synthetic resin (for example, an aromatic nylon including a glass fiber). As illustrated in FIG. 1, the housing 30 integrally includes a plurality of (two) terminal housings 31 arranged next to each other. The terminal housings 31 are each configured to house each of a plurality of (two) male terminals 20.

Figure 5:
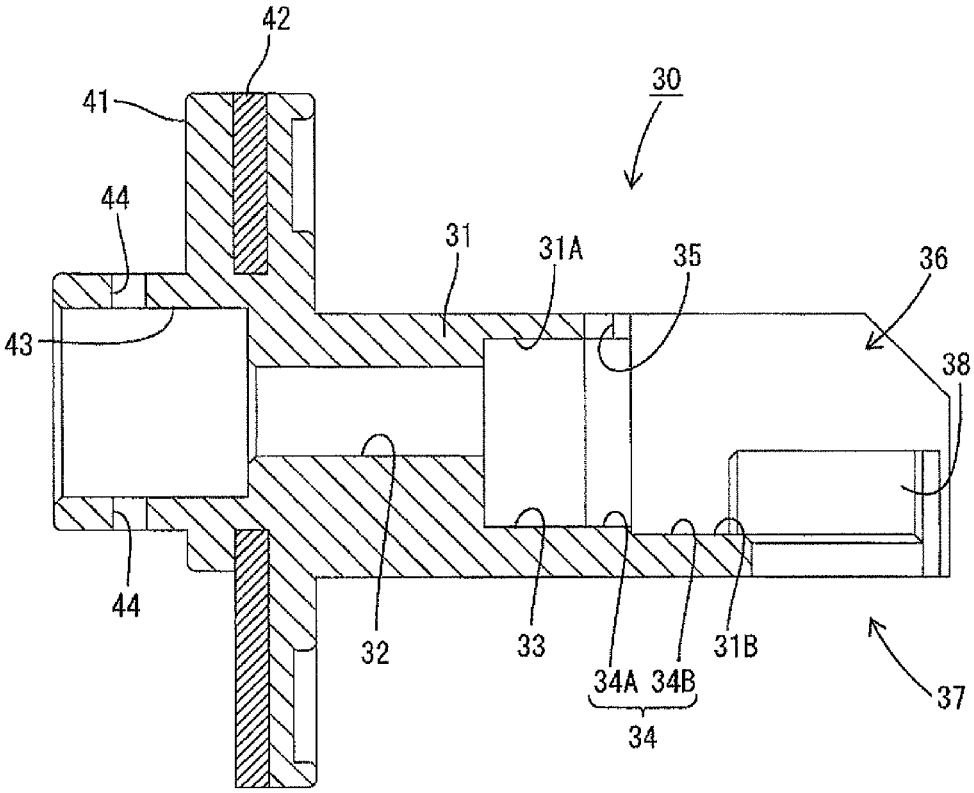
FIG. 5 is a vertical cross-sectional view of the housing.
Figure 6:
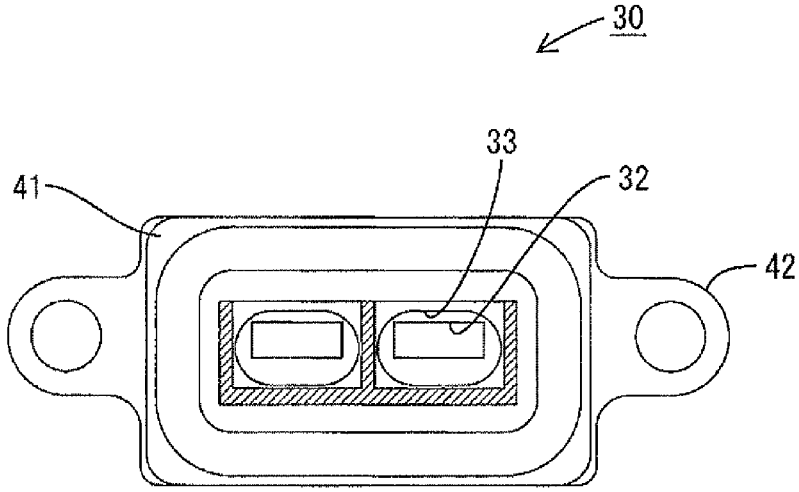
FIG. 6 is a horizontal cross-sectional view of the housing.

As illustrated in FIG. 6, each terminal housing 31 includes a flat cavity 32 through which the male terminal 20 can pass and the sealing ring receiving recess 33. The sealing ring receiving recess 33 is adjacent to the front side of the cavity 32 in a stepped manner with a larger diameter than the cavity 32. In addition, as illustrated in FIG. 5, the terminal housing 31 further includes a retainer mounting recess 34 adjacent to the front side of the sealing ring receiving recess 33 and a nut holding portion 37 for holding a nut 64 at a front end portion of the housing 30.

The cavity 32 extends through the housing 30 in the front-to-rear direction (such that the front and back portions of the housing 30 are communicated with each other). The cavity 32 has a flat oval shape elongated in the right-to-left direction and has a size enabling the male terminal 20 and the electric wire 11 to be passed therethrough.

The sealing ring receiving recess 33 has a landscape oval shape elongated in the right-to-left direction and has a size enabling the sealing ring 45 to be attached with substantially no gap therebetween. The sealing ring receiving recess 33 extends from the front end of the cavity 32 in a stepped manner with a larger diameter than the cavity 32.

The retainer mounting recess 34 includes a first recess 34A and a second recess 34B having the same shape. The first recess 34A is adjacent to the front end of the sealing ring receiving recess 33. The second recess 34B is adjacent to the front end of the first recess 34A in a stepped manner with a larger diameter than the first recess 34A. A locking hole 35 is formed through a top wall 31A (an upper portion of an inner wall) of (the retainer mounting recess 34 of) the terminal housing 31. The locking hole 35 has a rectangular shape elongated in the right-to-left direction. The housing 30 includes an opening 36 on the rear of the retainer mounting recess 34. The opening 36 opens upward and rearward. The retainer 50 is passed through the opening 36 to be mounted.

A lower wall 31B (a bottom wall) of (the second recess 34B of the retainer mounting recess 34) of the terminal housing 31 includes an extended portion extending frontward from the retainer mounting recess 34. At the extended portion, a nut holding portion 37 for holding the nut 64 is provided.

Figure 4:
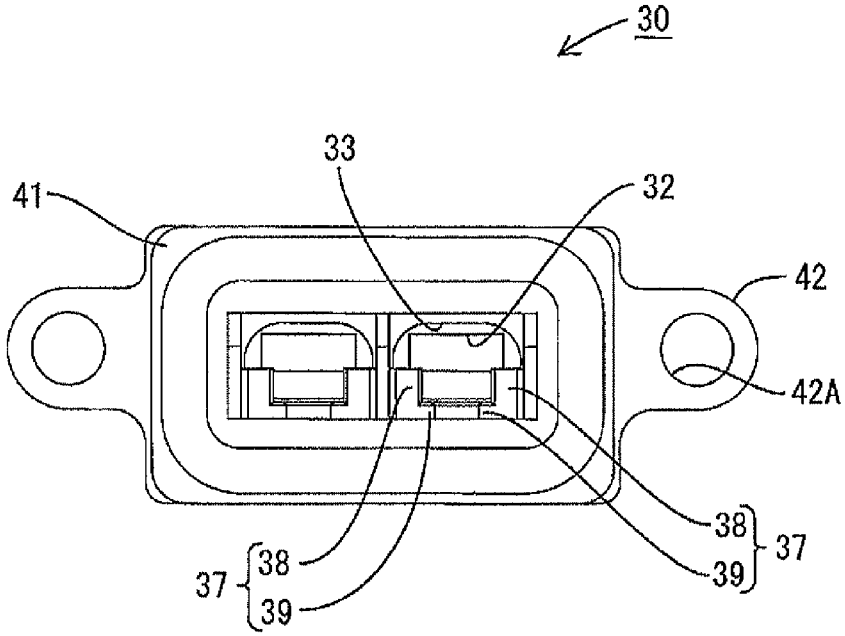
FIG. 4 is a front view of a housing.

As illustrated in FIG. 4, the nut holding portion includes right and left holding walls 38, 38 and a placement portion 39 on which the nut 64 can be placed. The holding walls 38, 38 position the nut 64 having a hexagonal outer shape in a non-rotatable manner. The placement portion 39 protrudes inwardly from a lower end of the holding walls 38, 38.

Figure 14:
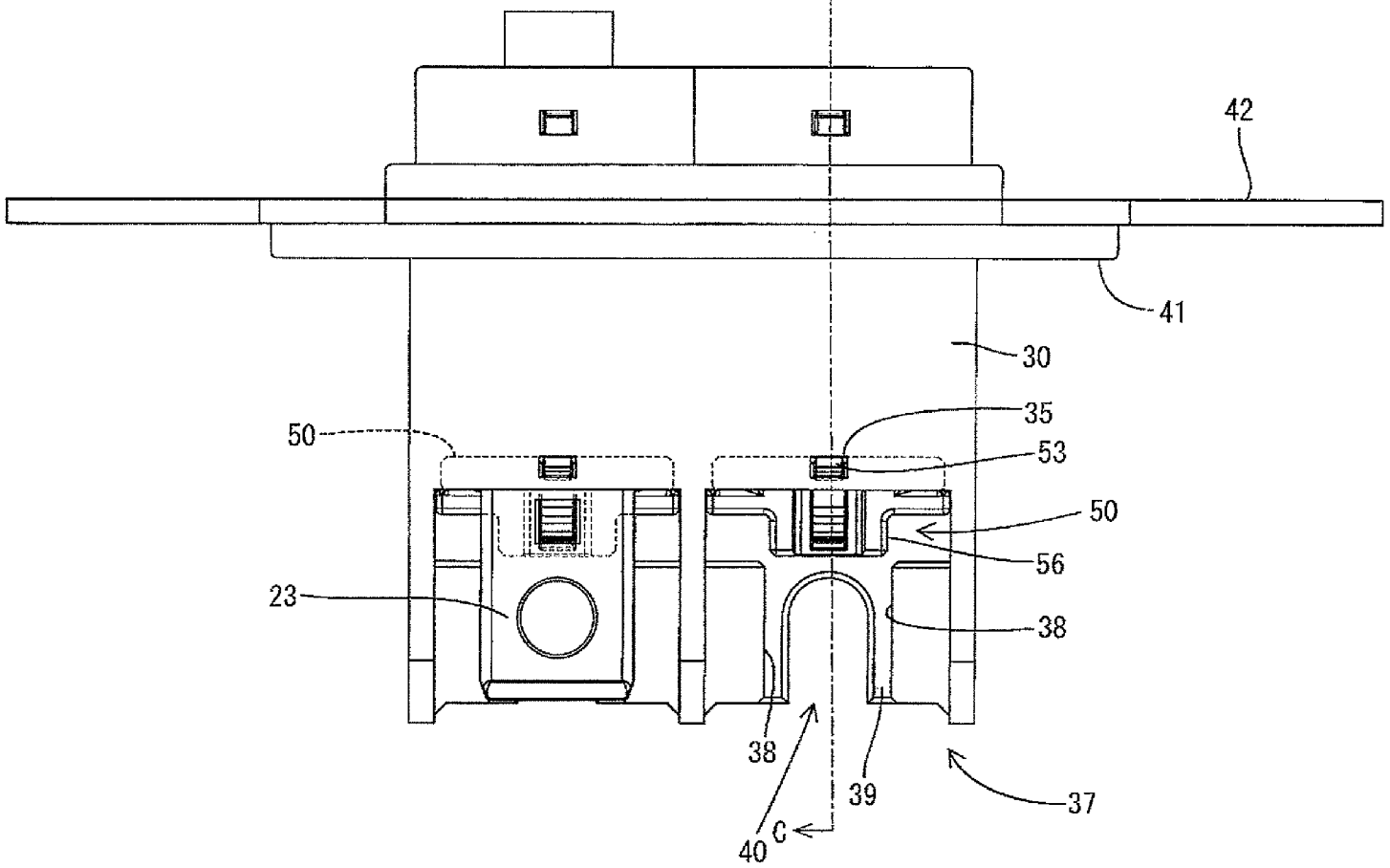
FIG. 14 is a view illustrating a state in which the retainer is inserted to a normal position.

As illustrated in FIG. 14, a space between the right and left holding walls 38, 38 is an insertion portion 40 opening frontward and rearward. With this configuration, the nut 64 can be inserted in the insertion portion 40 between the holding walls 38, 38 from the front side. Further, a small-width projected portion 56 of the retainer 50 can be inserted in the insertion portion 40 when the retainer 50 is in a temporary position (the position illustrated in FIG. 12), which will be described later. Compared with the housing in which rear ends of the holding walls 38, 38 are closed and the length thereof needs to be increased by the size corresponding to a portion of the housing 30 to which the small-width projected portion 56 is inserted, the housing 30 can be downsized in the front-to-rear direction.

The housing 30 includes a flange 41 protruding outwardly. To the flange 41, an attachment member 42 made of a metal plate and including an attachment hole 42A is fixed. The attachment member 42 is attached to a case of a device on a motor side to fix the connector 10 on a devise side.

Figure 11:
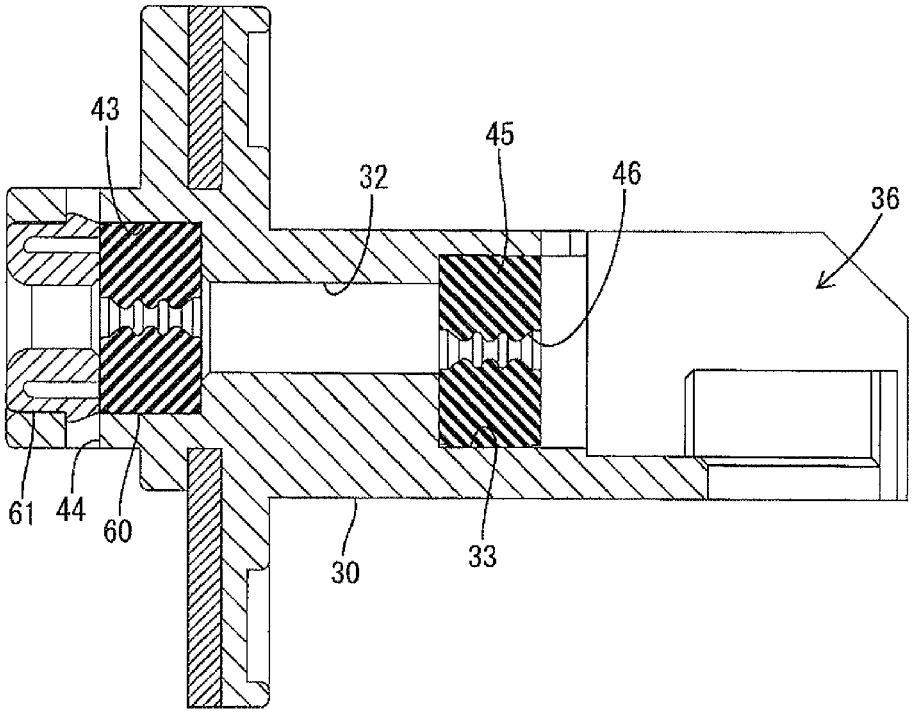
FIG. 11 is a view illustrating a state in which a rubber stopper and a sealing ring are attached in the housing.

The sealing ring 45 is an elastic member such as rubber an is configured to block the intrusion of liquid such as water and oil from the front side. As illustrated in FIG. 11, the sealing ring 45 has a landscape oval shape (corresponding to the sealing ring receiving recess 33) such that the sealing ring 45 is firmly attached to the inner wall of the sealing ring receiving recess 33.

The sealing ring 45 has a flat terminal insertion hole 46 at a middle portion thereof through which the protruded portion 23 of the male terminal 20 can be inserted.

Each of an outer circumferential surface of the sealing ring 45 and an inner surface of the terminal insertion hole 46 has wave-shaped lips.

Figure 7:
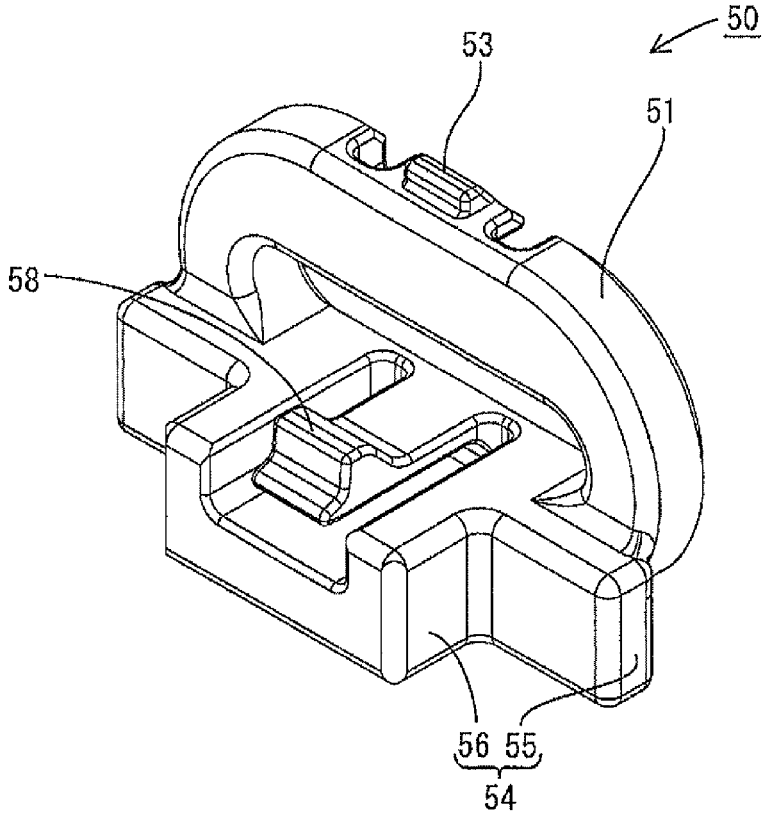
FIG. 7 is a perspective view of a retainer.

The retainer 50 is made of synthetic resin (for example, an aromatic nylon containing a glass fiber). As illustrated in FIG. 7, the retainer 50 includes a pressing portion 51 having a ring shape and a support portion 54 extending from a lower end portion of the pressing portion toward the front side. The pressing portion 51 is configured to press the sealing ring 45 from the front side. The support portion 54 is configured to support the pressing portion 51 from the front side.

Figure 8:
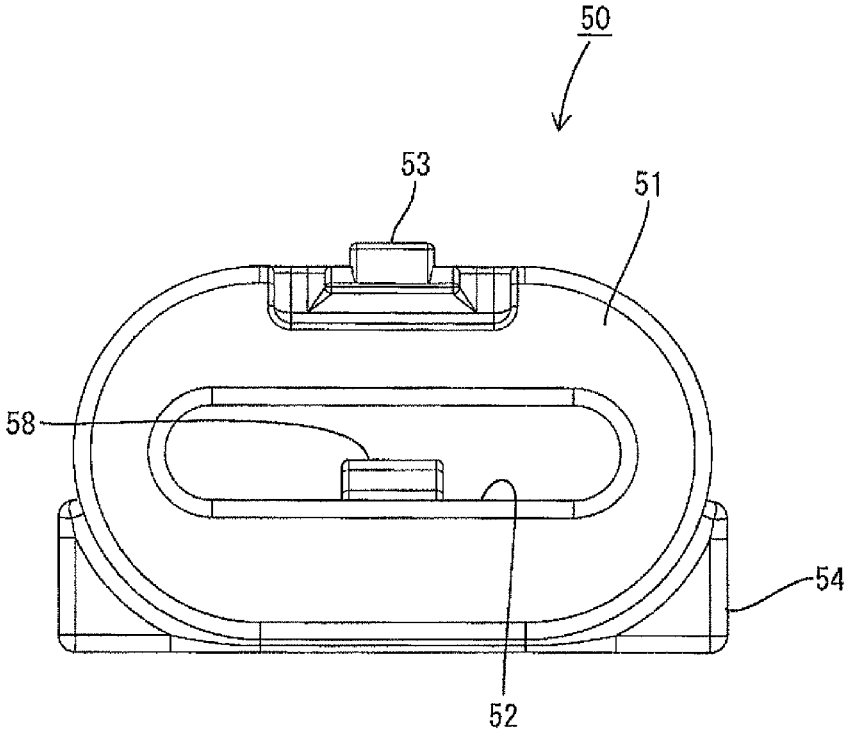
FIG. 8 is a rear view of the retainer.

As illustrated in FIG. 8, the pressing portion 51 has a landscape oval shape that is substantially the same shape as the sealing ring 45. The pressing portion 51 has a substantially constant width (a dimension in the front-to-rear direction) and has a terminal insertion hole 52 at the middle thereof through which the protruded portion 23 of the male terminal 20 is passed through.

The terminal insertion hole 52 has a landscape oval shape (that has a slightly larger size than a cross-section of the protruded portion 23) through which the protruded portion 23 can be inserted.

An upper portion of the pressing portion 51 includes a recess and a locking portion 53 protruding from the recess.

Figure 9:
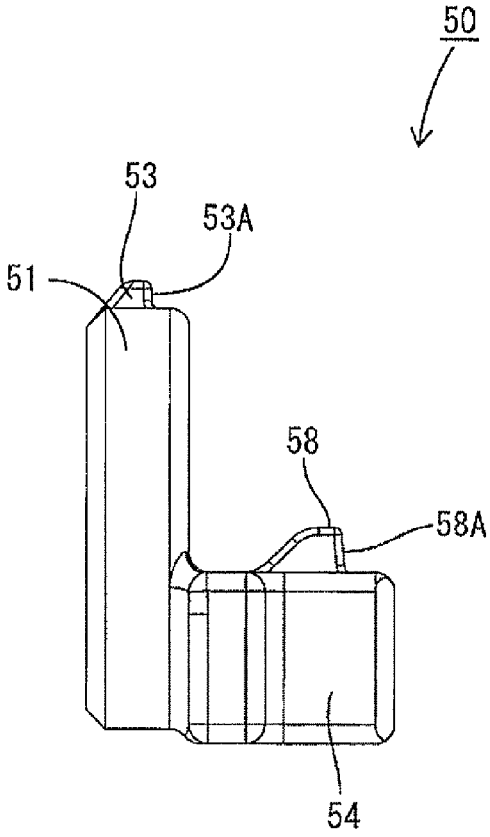
FIG. 9 is a side view of the retainer.
Figure 10:
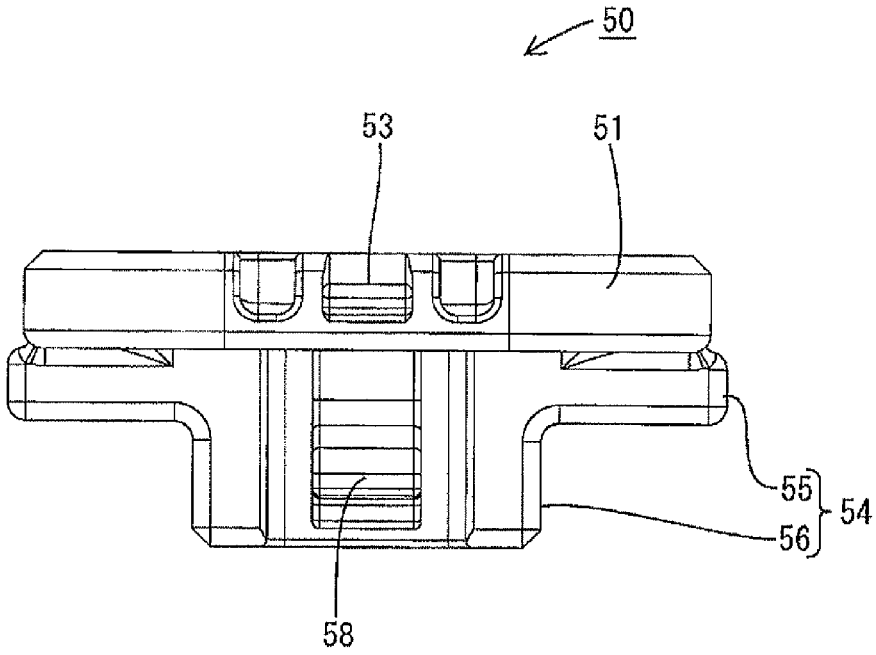
FIG. 10 is a plan view of the retainer.
Figure 15:
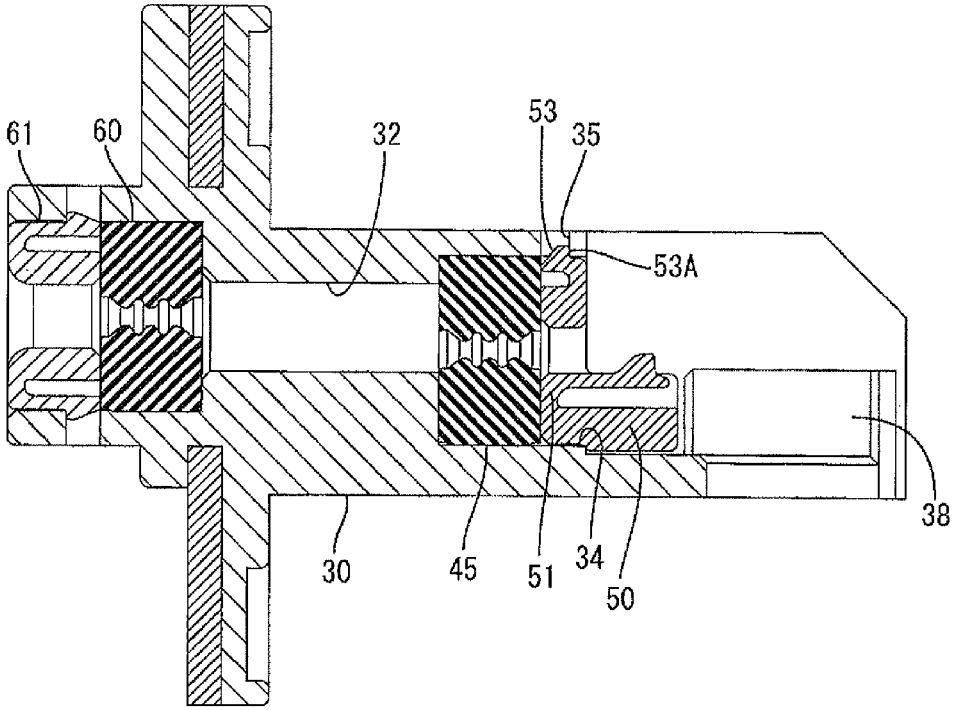
FIG. 15 is a cross-sectional view taken along a line C-C in FIG. 14.

The locking portion 53 protrudes upward a little from a most upper end of the oval shape of the pressing portion 51. As illustrated in FIG. 9, a front side of locking portion 53 is a stepped portion 53A that is a steep slope with a step and the height of the locking portion 53 gradually decreases from the top toward the rear side. As illustrated in FIG. 15, when the retainer 50 is inserted to a predetermined position to press the sealing ring 45, the stepped portion 53A that is the front side of the locking portion 53 is stopped at an edge of the locking hole 35 provided at the retainer mounting recess 34 of the housing 30, and thus the retainer 50 is positioned.

As illustrated in FIG. 7, the support portion 54 includes a projected portion 55 having a slightly larger width than the pressing portion 51 and the small-width projected portion 56 having a smaller width than the projected portion 55 in a stepped manner so as to be left in the middle of the support portion 54.

The small-width projected portion 56 is positioned at the middle of the projected portion 55 in the width direction. The width of the small-width projected portion 56 is slightly smaller than the dimension between the holding walls 38, 38 of the nut holding portion 37 (dimension of the insertion portion 40). A flexible piece 57 having a cantilever shape extends from the rear end portion of the upper surface of the support portion 54 toward the front side. The flexible piece 57 includes an engagement portion 58 protruding upward from the front end portion (the upper end portion) thereof.

The engagement portion 58 includes a stepped portion 58A that is a steep slope with a step on the front end thereof and the height of the engagement portion 58 gradually decreases from the top of the stepped portion 58A toward the rear side.

As illustrated in FIG. 2, the stepped portion 58A of the engagement portion 58 is engaged with (stopped by) the edge of the engagement hole 25 formed in the protruded portion 23 of the male terminal 20, and thus it hardly happens that the male terminal 20 moves rearward.

At a rear portion of the housing 30 through which the electric wire 11 passes, a terminal seal recess 43 is provided. In the terminal seal recess 43, a rubber stopper 60 and a rubber stopper holding member 61 are arranged. The electric wire 11 is inserted through wire insertion holes of the rubber stopper 60 and the rubber stopper holding member 61. Thus, water hardly enters the rear portion of the housing 30 through which the electric wire 11 passes.

An inner wall of the terminal seal recess 43 includes stopper holes 44. Nails 61A of the rubber stopper holding member 61 are stopped by the stopper hole 44, and thus the rubber stopper 60 is positioned.

An assembly of the connector 10 according to the present embodiment will be explained.

As illustrated in FIG. 11, the rubber stopper 60 and the rubber stopper holding member 61 are fitted into the terminal seal recess 43 at the rear portion of the housing 30. The sealing ring 45 is fitted into the sealing ring receiving recess 33 through the opening 36 of the housing 30.

Figure 12:
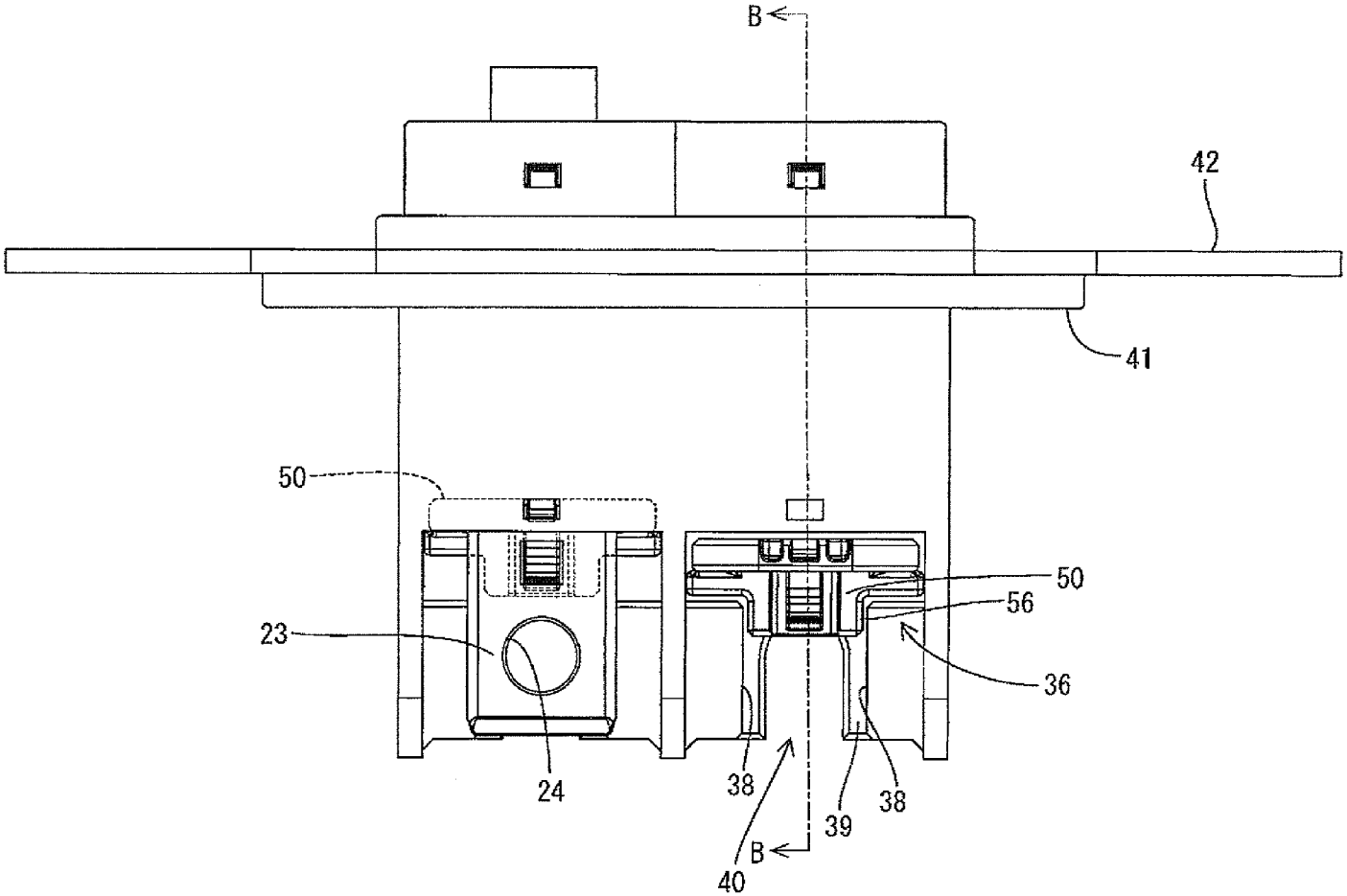
FIG. 12 is a view illustrating a state in which the retainer is inserted to a temporary position.
Figure 13:
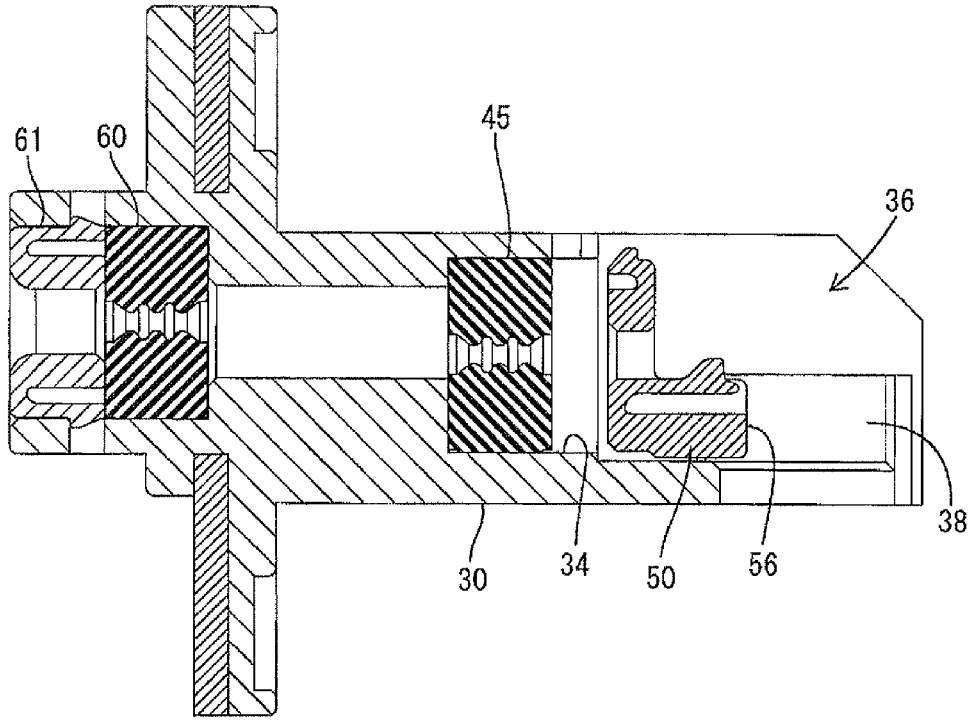
FIG. 13 is a cross-sectional view taken along a line B-B in FIG. 12.

Then, as illustrated in FIG. 12 and FIG. 13, the retainer 50 is inserted through the opening 36 to a temporary position (the position of the retainer 50 on the right in FIG. 12, the position of the retainer 50 in FIG. 13) in which the small-width projected portion 56 is inserted between the holding walls 38, 38.

Then, as illustrated in FIG. 14 and FIG. 15, the retainer 50 at the temporary position is slid to a normal position (the position of the retainer 50 on the right in FIG. 14, the position of the retainer 50 in FIG. 15) in which the retainer 50 presses the sealing ring 45. The locking portion 53 of the retainer 50 is stopped by the locking hole 35 of the housing 30, and thus the retainer 50 is positioned.

Figure 16:
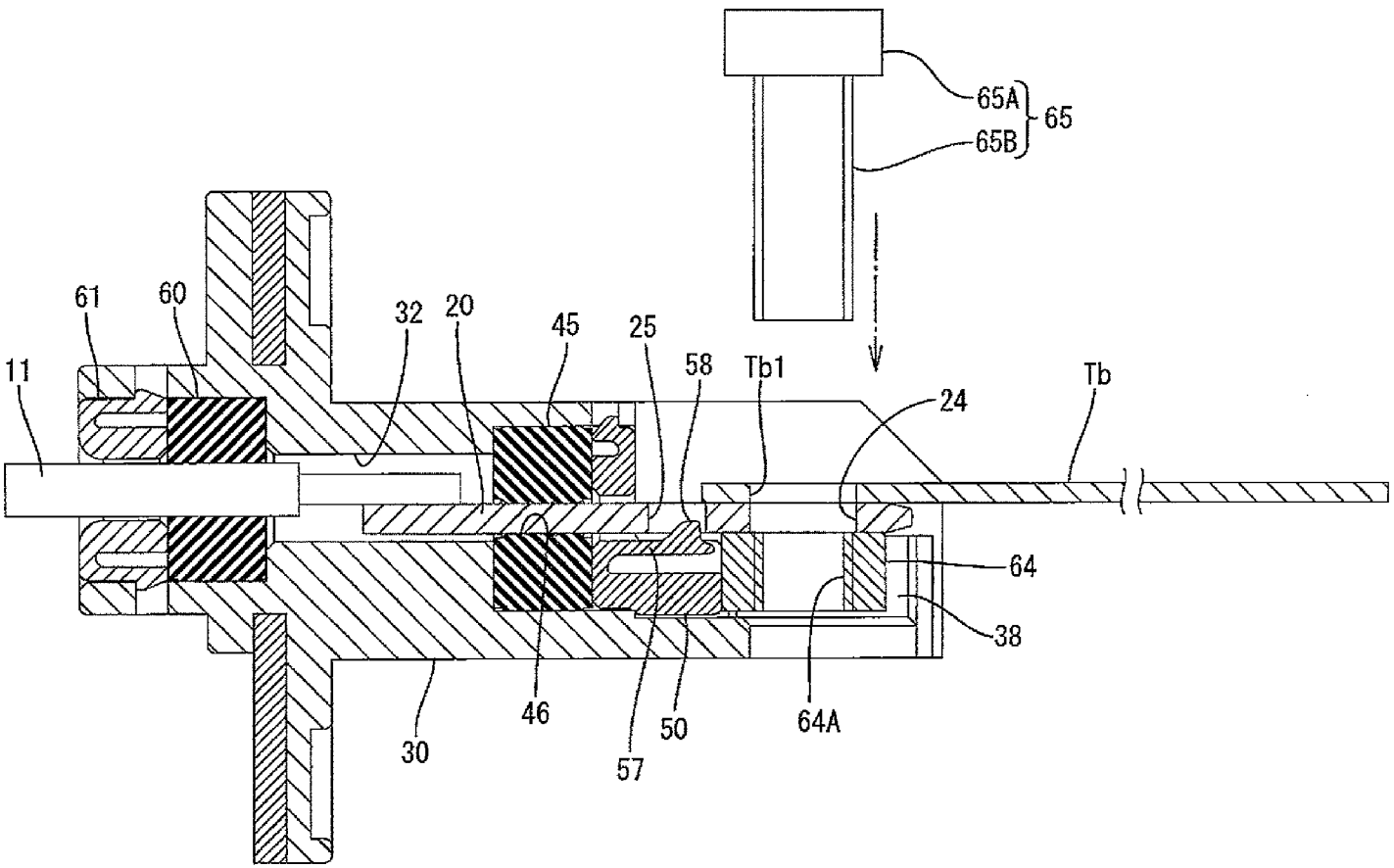
FIG. 16 is an explanation view illustrating a state in which a nut is held in a nut holding portion and a male terminal is to be bolted to a terminal to be connected.

Then, as illustrated in FIG. 16, the male terminal 20 connected with the end portion of the electric wire 11 is inserted into the cavity 32 through the wire through holes of the rubber stopper 60 and the rubber stopper holding member 61 from the rear side of the housing 30. Further, the male terminal 20 is inserted through the terminal through hole 46 of the sealing ring 45 and the terminal through hole 52 of the retainer 50 such that the engagement portion 58 of the retainer 50 is inserted into the engagement hole 25 in the protruded portion 23 of the male terminal 20.

In addition, the nut 64 is inserted (held) so as to be positioned at a predetermined position between the holding walls 38, 38 of the nut holding portion 37. The nut 64 is held by the holding walls 38, 38 in a non-rotatable manner. The screw hole 64A for the nut 64 and the bolt hole 24 for the male terminal 20 are communicated with each other.

Then, a bolt hole Tb1 in a male tab Tb of a mating terminal to be connected (an example of a mating member to be connected) is positioned. The axial portion 65B of the bolt 65 is passed through the bolt hole Tb1 in a direction indicated by an arrow in FIG. 16. The mating member to be connected is bolted to the nut 64 by pressing a head 65A of the bolt 65 with a jig. Here, the male terminal 20 is directly connected to the terminal to be connected. However, the male terminal 20 may be connected to the mating terminal to be connected with a mating connecter of the terminal to be connected, or may be connected to another mating member than the terminal. For example, if the mating member to be connected is an enamel wire, the enamel wire bent into a hook-like shape may be arranged along the edge of the bolt hole 24 of the male terminal 20 and bolted.

The following effects are obtained according to the present embodiment.

(1) The connector 10 includes the housing 30 (the connector housing) having a cavity 32, the male terminal 20 (the terminal) having the protruded portion 23, the sealing ring receiving recess 33 included in the connector housing 30, the sealing ring 45 arranged in the sealing ring receiving recess 33, and the retainer 50 mounted in the connector housing 30 and pressing the sealing ring 45 from a front side of the protruded portion 23 of the male terminal 20. The male terminal 20 is housed in the cavity 32 in a way that the protruded portion 23 protrudes from the housing 30. The sealing ring receiving recess 33 is located at a position corresponding to a base section of the male terminal 20 that is on a side from which the protruded portion 23 protrudes. The male terminal 20 passes through the sealing ring 45 such that the sealing ring 45 seals a space between the male terminal 20 and an inner surface of the sealing ring receiving recess 33. The retainer 50 includes an engagement portion 32 engaged with the male terminal 20.

With this configuration, the retainer 50 mounted to the connector housing 30 can prevent the sealing ring 45 from being incorrectly positioned, because the retainer 50 presses the sealing ring 45 from the front side of the protruded portion 23 of the male terminal 20. In addition, the retainer 50 includes the engagement portion 58 engaging with the male terminal 20. Thus, it hardly happens that the male terminal 20 drops off from the cavity 32.

(2) The male terminal 20 is the male tab terminal, and thus the attachment structure of the sealing ring 45 can be simplified.

(3) The protruded portion 23 includes the bolt hole 24 (the through hole). The bolt 65 passes through the bolt hole 24 to be engaged with the nut 64 such that the male tab Tb (the mating member to be connected) is bolted and fixed to the protruded portion 23. Thus, the protruded portion 23 can be firmly connected to the terminal to be connected.

(4) The housing 30 includes the nut holding portion 37 for holding the nut 64. This improves workability of bolting of the bolt 65.

(5) The nut holding portion 37 includes the holding walls 38, 38. The retainer 50 includes the pressing portion 51 pressing the sealing ring and the support portion 54 supporting the pressing portion 51 from the side opposite to the sealing ring 45. At least a part of the support portion 54 is inserted between the holding walls 38, 38.

The retainer 50 is generally required to be away from the holding walls 38, 38 to have an enough space for mounting the retainer 50. According to the present embodiment, the small-width projected portion 56 that is the at least a part of the support portion 54 is inserted between the holding walls 38, 38. This can reduce the space between the retainer 50 and the nut holding portion 37 for mounting the retainer, compared with the case in which the support portion 54 is not inserted between the holding walls 38, 38. This can downsize the connector 10.

<Second Embodiment>

Figure 17:
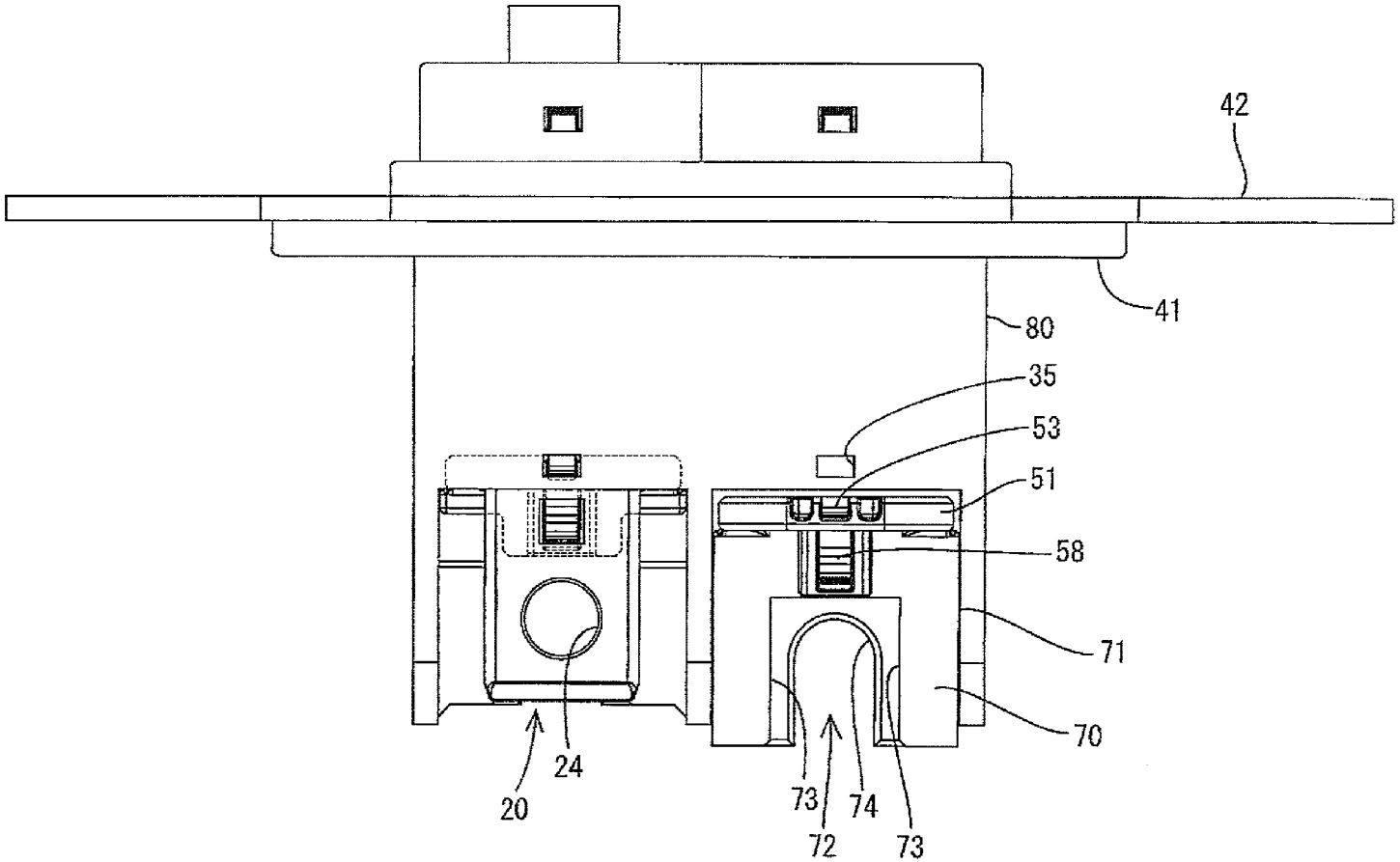
FIG. 17 is a view illustrating a state in which a retainer according to a second embodiment is inserted to a temporary position.
Figure 18:
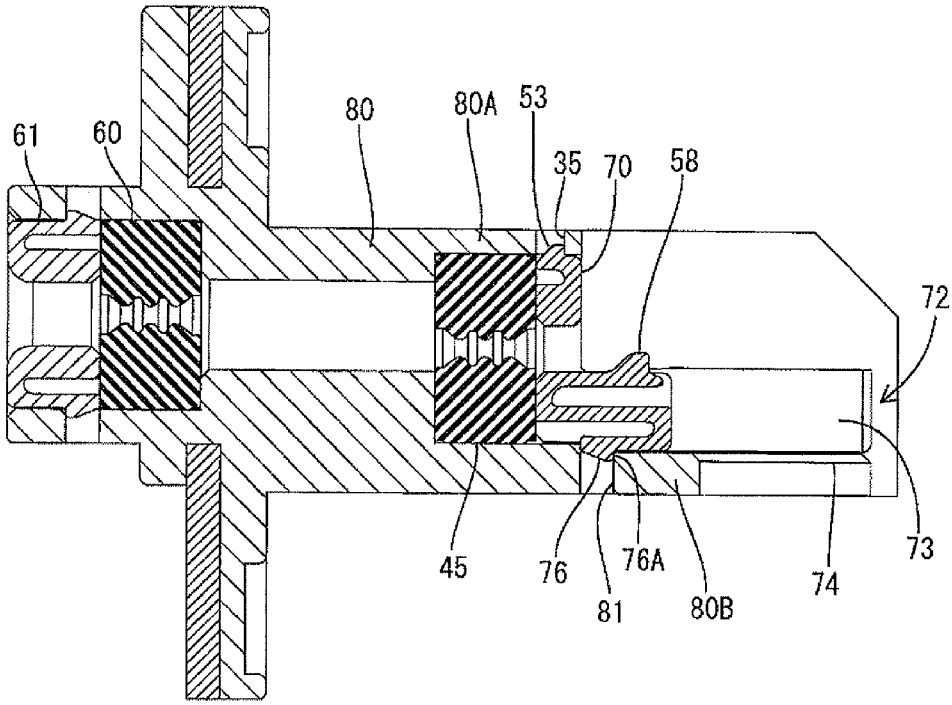
FIG. 18 is a view illustrating a state in which a retainer is inserted to a normal position.

A second embodiment of the present invention will be explained with reference to FIG. 17 and FIG. 18. According to the first embodiment, the nut holding portion 37 is provided in the housing 30. However, according to the second embodiment, as illustrated in FIG. 17, a nut holding portion 72 is integrally formed with a retainer 70. Further, according to the first embodiment, one locking hole 35 is formed in the upper portion of one terminal housing 31 of the housing 30 and one locking portion 53 is provided on the upper portion of one retainer 50. However, according to the second embodiment, as illustrated in FIG. 18, each of locking holes 35, 81 is formed in each of upper and lower portions of one terminal housing 31 of the housing 30 and each of locking portions 53, 76 is provided on each of upper and lower portions of one retainer 70. The other members are same as those of the first embodiment and will not be explained.

As illustrated in FIG. 17, the nut holding member 72 is provided at a support portion 71 continuously extending frontward from the pressing portion 51 of the retainer 70.

The nut holding member 72 includes right and left holding walls 73, 73 and a placement portion 74. The holding walls 73, 73 hold the nut 64 having a hexagonal outer shape in a non-rotatable manner. The placement portion 74 protrudes inwardly from a lower end of the holding walls 73, 73 and the nut 64 can be placed thereon.

A space between the right and left holding walls 73, 73 is an insertion portion opening in frontward and rearward. With this configuration, the nut 64 can be inserted in the nut holding member 72 from the front side.

Further, as illustrated in FIG. 18, in addition to the locking hole 35 in the top wall 80A, the housing includes the rectangular locking hole 81 in a bottom wall 80B. Further, in addition to the locking portion 53 on the upper end portion, the retainer 70 includes the locking portion 76 on a lower end portion thereof.

The locking portion 76 is provided at an end portion (a lower end portion) of a flexible pieces extending rearward in a cantilevered shape. A front end portion of the locking portion 76 is a stepped portion 76A that is a steep slope with a step. The height of the locking portion 76 gradually decreases from the top of the stepped portion 76A toward the rear side. The locking portion 76 on the lower side is longer than the locking portion 53 on the upper side.

According to the second embodiment, the nut holding portion 72 holding the nut 64 is not provided at the housing 80, but provided at the retainer 70. In other words, members interfering with the attachment of the sealing ring 45 or the retainer 70 are not provided in the housing 30. This facilitates the attachment of the sealing ring 45 or the retainer 70.

<Other Embodiments>

The present invention is not limited to the embodiments described in the above description and explained with reference to the drawings. The following embodiments may be included in the technical scope of the present invention, (1) In the above embodiments, the connector 10 to which two male terminals 20 are attached is explained. However, the technology according to the present invention can be applied to the connector to which one, or three or more terminals are attached. For example, the technology can be applied to a connector to which six terminals attached to end portions of two sets of three wires 11, which can transmit three-phrase electric power, are mounted.

(2) The male terminal 20 is attached to the connector 10. However, a female terminal may be attached to the connector 20. Additionally, the terminal to be connected to the mal terminal 20 is not limited to the male tab Tb. The terminal to be connected may have a female structure.

(3) In the present embodiments, the nut holding portion 37, 72 is formed in the housing 30 or the retainer 70. However, the nut holding portions 37, 72 may not be provided.

The connector according to a technology disclosed herein includes a connector housing having a cavity, a terminal having a protruded portion, a sealing ring receiving recess included in the connector housing, a sealing ring arranged in the sealing ring receiving recess, and a retainer mounted in the connector housing and pressing the sealing ring from a front side of the protruded portion of the terminal. The terminal is housed in the cavity in a way that the protruded portion protrudes from the connector housing. The sealing ring receiving recess is located at a position corresponding to a base section adjacent to the protruded portion of the terminal. The terminal passes through the sealing ring such that the sealing ring seals a space between the terminal and an inner surface of the sealing ring receiving recess. The retainer includes an engagement portion engaged with the terminal.

According to this configuration, the retainer mounted to the connector housing presses the sealing ring from the front side of the protruded portion of the terminal. In addition, the retainer includes the engagement portion to be engaged with the terminal. Thus, the terminal hardly drops off from the cavity and the sealing ring is hardly incorrectly positioned.

The following configurations are further preferable.

The terminal may be a male tab terminal.

With this configuration, an attachment structure of the sealing ring can be simplified.

The protruded portion may have a through hole through which a bolt passes and engages with a nut in such a way that a mating member is bolted and fixed to the terminal.

With this configuration, the protruded portion can be firmly connected to the mating member to be connected.

In the housing, the nut holding portion for holding the nut is provided.

This configuration improves workability of bolting.

The nut holding portion includes a pair of holding walls. The retainer includes a pressing portion pressing the sealing ring and a support portion supporting the pressing portion from a side opposite to the sealing ring. At least a part of the support portion is inserted between the holding walls.

The retainer is generally required to be away from the holding walls to have an enough space for mounting the retainer. However, according to the present embodiment, at least a part of the support portion is inserted between the holding walls. This can reduce the space between the retainer and the nut holding portion for mounting the retainer, compared with the case in which the support portion is not inserted between the holding walls. This can downsize the connector.

The retainer may be provided with the nut holding member for holding the nut.

With this configuration, the nut holding portion is not required to be formed in the housing, and thus the members interfering with the attachment of the sealing ring and the retainer can be eliminated. This facilitates the attachment of the sealing ring and the retainer.

According to the technology disclosed herein, the terminal hardly drops off from the cavity and the sealing ring is hardly incorrectly positioned.

The invention claimed is:

1. A connector comprising:

a connector housing having a cavity and a sealing ring receiving recess;

a terminal having a protruded portion and a base section, the terminal being housed in the cavity in a way that the protruded portion protrudes from the connector housing and the base section is housed in the connector housing;

a sealing ring arranged in the sealing ring receiving recess, the terminal passing through the sealing ring such that the sealing ring seals a space between the terminal and an inner surface of the sealing ring receiving recess; and a retainer mounted in the connector housing and pressing the sealing ring from a front side of the protruded portion of the terminal, the retainer including an engagement portion engaged with the terminal, wherein the sealing ring receiving recess is located at a position corresponding to the base section of the terminal.

2. The connector according to claim 1, wherein the terminal is a male tab terminal.

3. The connector according to claim 1, further comprising a bolt and a nut, wherein the protruded portion has a through hole through which the bolt passes to be engaged with the nut such that a mating member is bolted and fixed to the terminal.

4. The connector according to claim 3, wherein the connector housing includes a nut holding portion.

5. The connector according to claim 4, wherein the nut holding portion includes a pair of holding walls, the retainer includes a pressing portion pressing the sealing ring and a support portion supporting the pressing portion from a side opposite to the sealing ring, and at least a part of the support portion is inserted between the holding walls.

6. The connector according to claim 3, wherein the retainer includes a nut holding portion.

* * * * *